US007030841B2

(12) United States Patent
Abe et al.

(10) Patent No.: US 7,030,841 B2
(45) Date of Patent: Apr. 18, 2006

(54) ORGANIC EL ELEMENT DRIVE CIRCUIT AND ORGANIC EL DISPLAY DEVICE USING THE SAME

(75) Inventors: Shinichi Abe, Kyoto (JP); Masanori Fujisawa, Kyoto (JP); Yoshio Matoba, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 404 days.

(21) Appl. No.: 10/636,528

(22) Filed: Aug. 8, 2003

(65) Prior Publication Data

US 2004/0155840 A1 Aug. 12, 2004

(30) Foreign Application Priority Data

Aug. 14, 2002 (JP) ..... 2002-236296

(51) Int. Cl.
*G09G 3/30* (2006.01)

(52) U.S. Cl. ..... 345/76; 345/77

(58) Field of Classification Search ..... 345/76, 345/77, 78, 82, 83, 84, 204; 313/498, 499, 313/500, 505, 169.1, 169.2, 169.3
See application file for complete search history.

(56) References Cited

U.S. PATENT DOCUMENTS

| | | | | |
|---|---|---|---|---|
| 6,531,827 | B1 * | 3/2003 | Kawashima | 315/169.3 |
| 6,586,888 | B1 * | 7/2003 | Kitahara et al. | 315/169.1 |
| 6,747,417 | B1 * | 6/2004 | Meade et al. | 315/169.3 |
| 2002/0135314 | A1 * | 9/2002 | Kitahara et al. | 315/169.3 |

* cited by examiner

*Primary Examiner*—Vijay Shankar
*Assistant Examiner*—Nitin Patel
(74) *Attorney, Agent, or Firm*—Mattingly, Stanger, Malur & Brundidge, P.C.

(57) ABSTRACT

An organic EL element drive circuit including a reference current setting circuit for at least one of three primary display colors, the reference current setting circuit comprises a first reference current generator circuit for generating a reference current, a second reference current generator circuit responsive to a first setting data for generating a current as a reference for luminance regulation on a basis of the reference current generated by the first reference current generator circuit and a reference current correction circuit for generating a corrected reference current as said predetermined reference current by adding a current according to a second setting data to a reference current generated by said second reference current generator circuit or subtracting a current according to said second setting data from said reference current generated by said second reference current generator circuit. The first and second setting data are set from the outside of the organic EL element drive circuit.

12 Claims, 3 Drawing Sheets

ORGANIC EL ELEMENT DRIVE CIRCUIT AND ORGANIC EL DISPLAY DEVICE USING THE SAME

BACKGROUND OF THE INVENTION

1. Field of the Invention

The present invention relates to an organic EL element drive circuit and an organic EL display device using the same drive circuit and, in particular, to an organic EL display device for use in an electronic device such as a portable telephone set or a PHS, etc., which can provide a wide dynamic range in regulating a drive current and is capable of absorbing luminance difference due to difference of organic EL light emitting material and which is suitable for high luminance color display.

2. Prior Art Description

An organic EL display panel of an organic EL display device to be mounted on a portable telephone set, a PHS, a DVD player or a PDA (Personal Digital Assistance), etc., having 396 (132×3) column line terminal pins and 162 row line terminal pins has been proposed and the number of the column line terminal pins as well as the row line terminal pins tends to be still increasing.

An output stage of a current drive circuit of such organic EL display panel includes current source drive circuits, for example, output circuits using current mirror circuits, provided correspondingly to the terminal pins regardless of the type thereof, i.e., active matrix type or passive matrix type.

The problems of the organic EL display device are that, if a voltage drive is used as in the liquid crystal display device, variation of luminance becomes large and that a display control becomes difficult due to difference in luminance between red, green and blue color. Therefore, ratio of light emitting efficiency for red (R), green (G) and blue (B) colors becomes, for example, R:G:B=6:11:10 even if the current drive is used. In addition, the light emitting efficiency depends upon material of the organic EL element to be used.

Therefore, in order to obtain white balance on a display screen, the current drive circuits for a color display include drive current regulator circuits for regulating luminance of R, G and B colors correspondingly to the organic EL materials to be used.

Since, in the current drive circuit of the organic EL display device, the drive current for each color is usually generated for each of the respective column pins by amplifying a reference current, the regulation of drive current for obtaining white balance is performed by regulating the reference currents corresponding to red, green and blue colors.

It has been usual that, in order to regulate the reference currents, a reference current generator of the conventional drive current regulation circuit, which is provided for each of R, G and B, includes a D/A converter circuit of about 4 bits and the reference current is regulated by setting a predetermined bit data within a range from 30 μA to 75 μA with step of, for example, 5 μA. However, since various organic EL materials have been developed, the luminance regulation range of the 4-bit D/A inverter circuit is insufficient.

If, in order to solve this problem, the number of bits of the D/A inverter circuit is increased to 6 to 8, the circuit size of the drive current regulator circuit becomes substantial, so that it becomes difficult to provide the current drive circuit as one chip, causing miniaturization of the display device to be impossible.

On the other hand, there is a recent request of a dynamic range of reference current regulation within a range from 0 μA to 75 μA with step of 1 μA.

SUMMARY OF THE INVENTION

An object of the present invention is to provide an organic EL element drive circuit, which is capable of making sure a wide dynamic range for drive current regulation, absorbing difference of luminance due to difference of organic EL material and facilitating luminance regulation for such as white balance, etc., and is suitable for use in high luminance color display.

Another object of the present invention is to provide an organic EL display device, which is capable of making sure a wide dynamic range for drive current regulation and is suitable for high luminance color display.

In order to achieve these objects, an organic EL element drive circuit according to the present invention, which includes a reference current setting circuit for generating a predetermined reference current for at least one of three primary display colors by receiveing a first reference current supplied from a first reference current generator circuit, is featured by that the reference current setting circuit comprises a second reference current generator circuit responsive to a first setting data for generating a current as a reference for luminance regulation on a basis of the first reference current and a reference current correction circuit for generating a corrected reference current as the predetermined reference current by adding a current according to a second setting data to a reference current generated by the second reference current generator circuit or subtracting a current according to the second setting data from the reference current generated by said second reference current generator circuit, the first and second setting data being set from the outside of said organic EL element drive circuit.

An organic EL display device according to the present invention is featured by comprising a plurality of the above mentioned organic EL element drive circuits.

In the present invention, the current, which becomes a reference of luminance regulation for at least one of three primary display colors, is generated according to the first setting data, which is settable from the outside of the drive circuit, and then the corrected reference current is generated for every primary display color by correcting the reference current according to the second setting data. Therefore, the reference current before correction can be selected for every primary color as an average value or a center value, which is determined according to EL material variation and/or fabrication variation thereof, or a design value thereof and the luminance regulation is performed by using the selected current value as a reference. Therefore, a range of correction to be made for the selected current value becomes very small. As a result, it is possible to perform highly precise current regulation without necessity of wide dynamic range. On the other hand, since it is enough to generate the reference current with an interval which is within a correctable range, it is not necessary to provide a wide dynamic range in current selection.

As such, according to the present invention, it is possible to provide a wide dynamic range for regulation of the drive current by roughly setting the reference current generated by the reference current generator circuit for every display colors and then finely regulating the reference current.

As a result, it is possible to realize the current drive adaptable for variation of organic EL material without influence of luminance variation thereof. Thus, the luminance regulation for white balance, etc., is facilitated, so that the organic EL element drive circuit suitable for high luminance color display and an organic EL display device using the same can be realized.

DETAILED DESCRIPTION OF THE PREFERRED EMBODIMENTS

Figure 1:
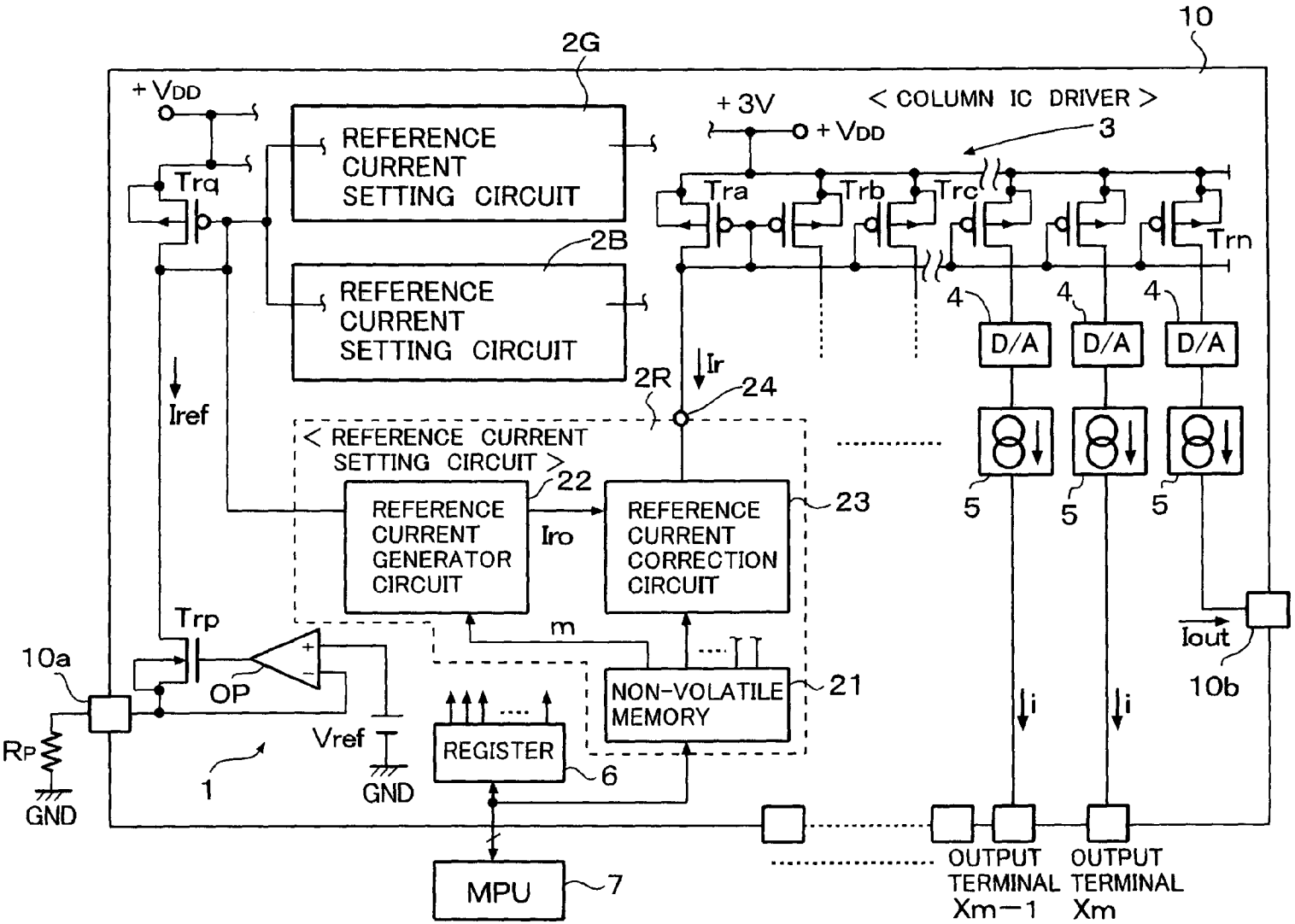
FIG. 1 is a block circuit diagram of an organic EL display panel including an organic EL element drive circuit according to an embodiment of the present invention.

FIG. 1 is a block circuit diagram of an organic EL element drive circuit (referred to as "column IC driver", hereinafter) 10 of an organic EL display panel.

The column IC driver 10 includes a reference current generator circuit 1, a current-mirror type reference current setting circuit 2R for R display color, a current-mirror type reference current setting circuit 2G for G display color and a current-mirror type reference current setting circuit 2B for B display color.

The reference current setting circuits 2R, 2G and 2B receive a reference current Iref generated by the reference current generator circuit 1 and generates reference currents for the respective display colors.

The reference current generator circuit 1, which generates the reference current Iref used commonly by the reference current setting circuits 2R, 2G and 2B, is constructed with an operational amplifier OP, an N channel transistor Trp driven by an output of the operational amplifier OP supplied to its gate, a resistor Rp provided between a source of the transistor Trp and ground (GND) and a P channel transistor Trq having a drain connected to a drain of the transistor Trp. A source of the transistor Trq is connected to a power source line +VDD, which is, for example, 3V. The transistor Trq is commonly used as an input side transistor of the current mirror circuit of each of the reference current setting circuits 2R, 2G and 2B and drives P channel MOS FETs Tr1 to Trk (FIG. 2), which are output side transistors of the respective reference current setting circuits.

A (+) input of the operational amplifier OP is grounded through a reference voltage source Vref and a (−) input thereof is connected to the source of the transistor Trp. Incidentally, the resistor Rp is provided externally of the column IC driver and connected to the source of the transistor Trp through a terminal 10*a* of the IC driver.

Since a construction of each of the reference current setting circuits 2G and 2B is similar to that of the reference current setting circuit 2R, only the construction of the latter will be described in detail with reference to FIG. 1 and FIG. 2.

The reference current setting circuit 2R includes a non-volatile memory 21, which is used commonly by the reference current setting circuits 2G and 2B, a current-mirror type reference current generator circuit 22 and a current-mirror type reference current correction circuit 23. The current-mirror type reference current generator circuit 22 of the reference current setting circuit 2R generates a reference current corresponding to data value for R color. The data value is read out from a R data region of the non-volatile memory 21 and the reference current generated by the reference current generator circuit 22 may be m times the reference current Iref. The reference current correction circuit 23 is constructed with a corrected current generator circuit 23*a* and a current synthesizer circuit 23*b*, which are constructed with current-mirror circuits, respectively, as shown in FIG. 2. The corrected current generator circuit 23*a* generates a current to be added to or subtracted from the reference current Iro from the reference current generator circuit 22 with resolution of 1 μA. The current synthesizer circuit 23*b* synthesizes the reference current Iro from the reference current generator circuit 22 with the current from the corrected current generator circuit 23*a* to generate a corrected reference current Ir at an output terminal 24. Thus, an input side transistor Tra of the current mirror circuit 3 is driven by the corrected reference current Ir.

The current mirror circuit 3 includes, in addition to the input side transistor Ta, P channel MOS FETs Trb to Trn, which are current-mirror connected to the transistor Ta. Sources of the transistors Trb to Trn are connected to the power source line +VDD (=3V)

Drains of the transistors Trb to Trn are connected to D/A converter circuits 4, respectively, and currents from these drains become reference drive currents of the respective D/A converter circuits 4.

In response to display data supplied from an MPU 7 through a register 6, each of the D/A converter circuits 4 generates a drive current correspondingly to display luminance at each occasion by amplifying the reference drive current Ir correspondingly to the display data value and drives an output stage current source 5. The output stage current source 5 is constructed with a current mirror circuit composed of a pair of transistors and supplies a drive current to an anode of each organic EL element through one of column side output terminals X1 to Xm.

The drain of the last stage transistor Trn is connected to the D/A converter circuit 4 to drive the latter. The D/A converter circuit 4 drives the corresponding output stage current source 5 correspondingly to the data thus set to output an output current Iout of the output stage current source 5 to an external output terminal 10*b* of the column IC driver. This output current Iout is inputted to a next stage column IC driver in which it is used as a monitor current for generating a similar drive current.

Figure 2:
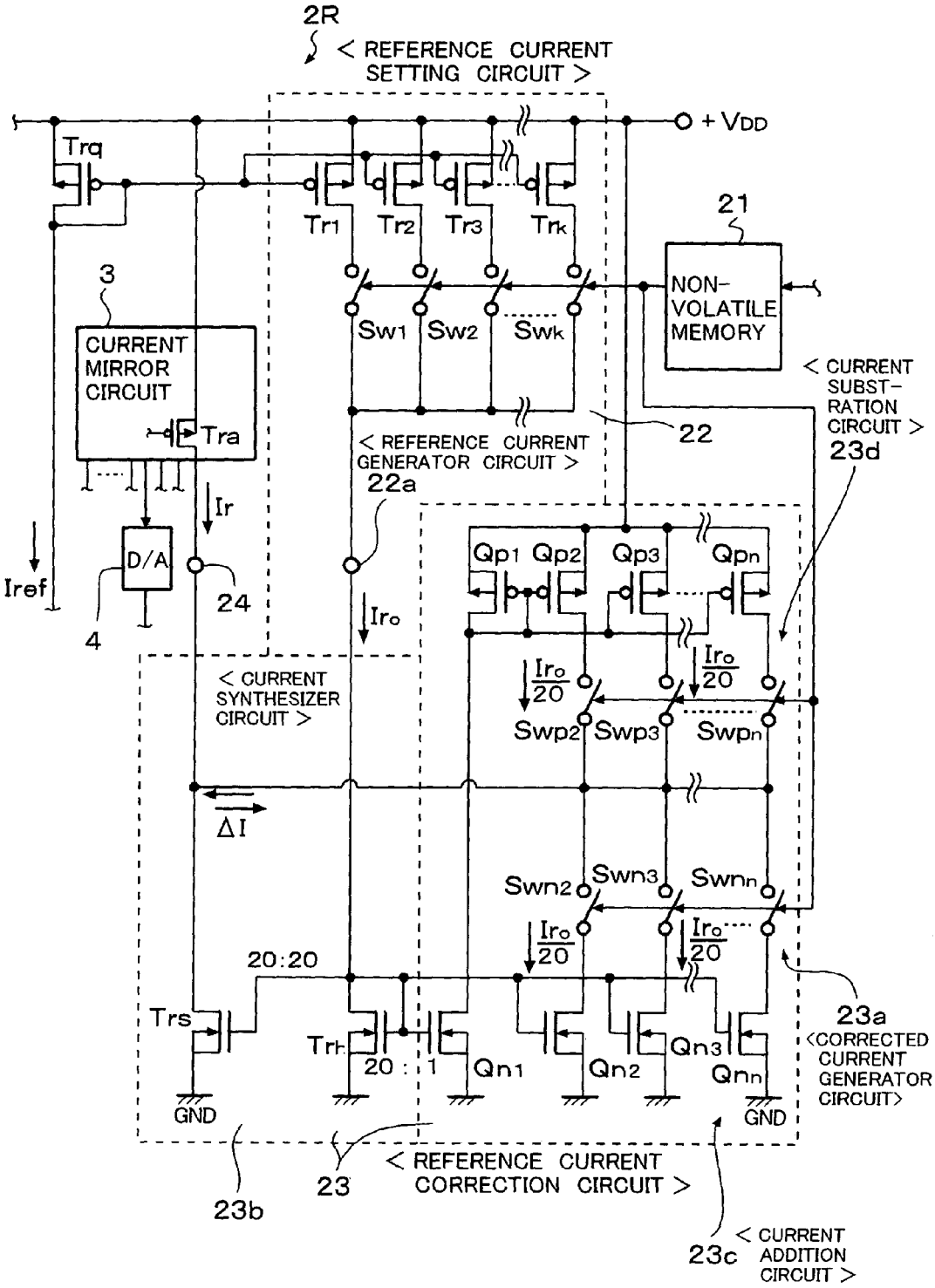
FIG. 2 is a block circuit diagram of a reference current generator circuit shown in FIG. 1.

The reference current setting circuit 2R whose detailed construction is shown in FIG. 2 functions as a current value regulation circuit, which is programmable by the data setting.

The reference current generator circuit 22 takes in the form of a current mirror circuit including P channel transistors Tr1 to Trk, which are driven by the transistor Trq in which the reference current Iref flows. Sources of the transistors Tr1 to Trk are connected to the power source line +VDD and drains thereof are connected to an output terminal 22*a* through switch circuits SW1 to SWk, respectively. Therefore, when one of the switch circuits SW1 to SWk is turned ON, a reference current Iro for R display color is supplied to the output terminal 22*a*. The output terminal 22*a* is connected to a drain of an input side transistor Trr of an N channel current mirror circuit of the current synthesizer circuit 23*b*. Therefore, the current Iro is supplied to the transistor Trr. A source of this transistor Trr is grounded.

The current synthesizer circuit 23*b* is constructed with a current mirror circuit composed of the transistor Trr as an input side transistor and an N channel transistor Trs as an output side transistor. A drain of the transistor Trs is connected to the output terminal 24 and a source thereof is grounded.

The corrected current generator circuit 23*a* includes a current addition circuit 23*c* and a current subtraction circuit 23*d*. The current addition circuit 23*c* is a current mirror circuit composed of N channel output transistors Qn1, Qn2, . . . , Qnn connected in current-mirror to the input side transistor Trr. Sources of the transistors Qn2 to Qnn are grounded and drains thereof are connected to the output terminal 24 through respective switch circuits SWn2 to SWnn. Therefore, current components generated correspondingly to ON/OFF operations of the switching circuits SWn2 to SWnn are sunk at the output terminal 24. As a result, the current components are added to the reference current Ir, which is sunk at the output terminal 24. Incidentally, the input side transistor Trr of the current synthesizer circuit 23*b* is an input side transistor of the current mirror circuit including the output side transistors Qn2 to Qnn.

The current synthesizer circuit 23*d* includes a current mirror circuit having an input side transistor Qp1 provided on an upstream side of the output transistor Qn1 and output side transistors Qp2 to Qpn connected in current-mirror to the input side transistor Qp1.

Sources of the transistors Qp1 to Qpn are connected to the power source line +VDD and drains of the transistors Qp2 to Qpn are connected to the output terminal 24 through switch circuits SWp2 to SWpn, respectively. Therefore, current components generated correspondingly to the ON/OFF operations of the switch circuits SWp2 to SWpn flow to the output terminal 24. As a result, the current components are subtracted from the reference current Ir.

Therefore, the reference current correction circuit 23 can regulate the reference current Ir at the output terminal 24 by selective ON/OFF operations of the switch circuits SWn2 to SWnn and SWp2 to SWpn. Incidentally, the current value to be added to or subtracted from the reference current Ir is determined by the number of switch circuits, which are turned ON.

In this embodiment, the gate width ratio of the transistor Trr to the transistor Trs is 20:20, that of the transistor Trr to each of the transistors Qp1 to Qpn is 20:1 and that of the transistor Trr to each of the transistors Qp1 to Qpn is 20:1. Therefore, the regulated current value can be added to or subtracted from the reference current Ir with resolution of Iro/20 where Iro is the current flowing from the output terminal 22. When Iro=20 μA, the resolution of the corrected current value becomes about 1 μA.

The ON/OFF operations of the switch circuits SW1 to SWk, the switch circuits SWn2 to SWnn and the switch circuits SWn2 to SWnn are performed correspondingly to the setting data for R display color stored in the non-volatile memory 21. The setting data for R display color is read out from the corresponding memory region of the non-volatile memory 21 by the MPU 7. Incidentally, it may be possible to automatically read out the data from-the non-volatile memory 21 when the power source is connected.

First, the current values corresponding to the respective G, R and B display colors are roughly set by selecting the ON/OFF operations of the switch circuits SW1 to SWk of the reference current generator circuit 22 and the reference current Iro for the R display color, which becomes a base of the luminance regulation, is generated. And then, in order to regulate the current Iro against luminance variation of the organic EL elements due to differences in material of the organic EL element and fabrication thereof, the ON/OFF states of the addition side switch circuits SWn2 to SWnn or the subtraction side switch circuits SWp2 to SWpn.

Data for performing these regulation is set in the non-volatile memory 21 from the outside of the organic EL element drive circuit through the MPU 7. Data, which is preliminarily obtained correspondingly to luminance of organic EL materials used for the R, G and B display colors, is stored in the non-volatile memory 21 and the switch circuits SW1 to SWk are ON/OFF controlled by the data. The data value in this case may be an average current value, a center current value or a designed current value, which are determined correspondingly to variation of EL material or to manufacturing variation of organic EL element.

Besides, the setting data for ON/OFF controlling the switch circuits SWn2 to SWnn and the switch circuits SWp2 to SWpn are determined by setting maximum luminance of every display color of every organic EL display device in the operational test stage or the shipping state thereof and measuring luminance of a display screen thereof by measuring means or eyes and white balance regulation is performed by setting the data from the outside of the drive circuit through the MPU 7.

The data is stored in regions of the non-volatile memory 21, which are assigned to the respective display colors, through the MPU 7 and sent to the reference current setting circuits 2R, 2G and 2B to ON/OFF control the switch circuits thereof.

Incidentally, the current addition circuit 23*c* or the current subtraction circuit 23*d* of the reference current correction circuit 23 in this embodiment shown in FIG. 2 generates a correction current in units of 1/20 of the current Iro generated by the reference current generator circuit 22 and adds the correction current to or subtracts it from the current Iro. Therefore, the correction current is determined correspondingly to the current Iro.

In order to avoid such problem on the correction, the number of switch circuits among the switch circuits SWn2 to SWnn, which are turned ON, and the number of switch circuits among the switch circuits SWp2 to SWpn, which are turned ON, may be changed. Alternatively, it is possible that the addition or subtraction current is a constant current unit. For example, instead of the previously described case in which the current for driving the current addition circuit 23*c* or the current subtraction circuit 23*d* is generated in the output side transistors Qn1 to Qnn of the current mirror circuit having the transistor Trr as the input side transistor, the transistor Qp1 and the transistors Qn2 to Qnn are driven by an input side transistor, which is provided separately from the transistor Trr and is driven by a current source for generating a current of about 1 μA.

Incidentally, it is possible to supply the outputs of the transistors Qn2 to Qnn of the current addition circuit 23*c* and the outputs of the transistors Qp2 to Qpn of the current subtraction circuit 23*d* to not the output terminal 24 but the output terminal 22*a* of the reference current generator circuit 22. In such case, the current addition circuit 23*c* functions as a current subtraction circuit and the current subtraction circuit 23*d* functions as a current addition circuit.

Figure 3:
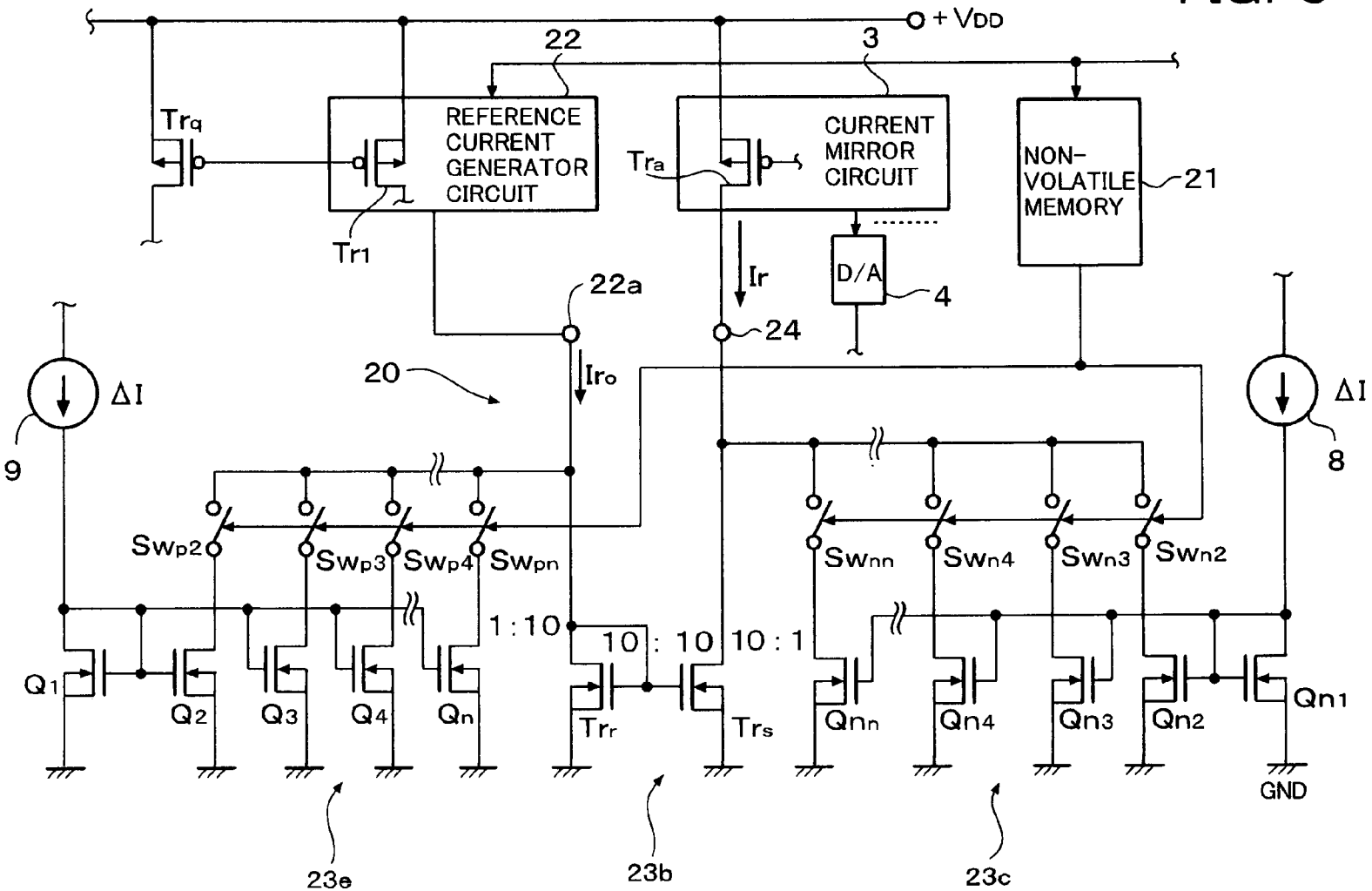
FIG. 3 is a detailed block circuit diagram of a reference current generator circuit according to another embodiment of the present invention.

FIG. 3 shows a detailed block circuit diagram of a reference current setting circuit 20, which is different from the reference current setting circuit shown in FIG. 2 in that a current subtraction circuit 23*e* in the form of a current mirror circuit composed of N channel transistors Q1 to Qn is used instead of the current subtraction circuit 23*d* shown in FIG. 2 and current sources 8 and 9 each generating a current ΔI corresponding to the reduction of 1 μA are connected to the input side and the output side of the current synthesizer circuit 23*b*, respectively, to add the current ΔI to the sink current Ir at an output terminal 24 or subtract it therefrom.

Shown in FIG. 2, the transistor Q1 of the current subtraction circuit 23*e* is an input side transistor and transistors Q2 to Qn of the current subtraction circuit 23*e* are output side transistors.

A current subtraction circuit 23*c*, which is identical to that shown in FIG. 2, is a current mirror circuit composed of N channel output transistors Qn2, . . . , Qnn connected in current-mirror to an input side transistor Qn1. The input side transistor Qn1 receives the drive current ΔI of the current source 8 to generate a mirror current by output transistors Qn2 to Qnn to the output terminal 24 through switch circuits SWn2 to SWnn. Therefore, a current ΔI×P is added to the current Ir from the output terminal 24, where P is the number of the switch circuits, which are turned ON at that time.

On the other hand, an input side transistor Q1 of the current subtraction circuit 23*e* receives the drive current ΔI from the power source 9 to generate a mirror current by output side transistors Q2 to Qn to thereby ground a portion of the current Iro from the output terminal 22*a*, which is the input side of the current synthesizer circuit 23*b*. Therefore, the drive current of the transistor Trr is reduced, so that the current Ir from the output terminal 24 is reduced by a current ΔI×K, where K is the number of the switch circuits, which are turned ON at that time.

The gate width ratio of the transistors Trs to each of the transistors Qn1 to Qnn is 10:1 and that of the transistor Trr to each of the transistors Q1 to Qn is 10:1. When ΔI=1 μA, resolution of the correcting current value becomes about 1 A.

A description of an operation of the embodiment shown in FIG. 3 is omitted since it is similar to that shown in FIG. 2.

Incidentally, the non-volatile memory 21 may be replaced by a volatile memory such as usual RAM or register. In such case, the required data may be stored in the volatile memory from the MPU 7 (or CPU) when the power source is turned ON or the display device is activated. The readout of the setting data from the non-volatile memory 21 or the RAM to which the data is transferred may be performed by a controller, etc., or the memory or the RAM may be put always in a read state.

Although the correcting current generator circuit includes the current addition circuit and the current subtraction circuit, it is possible, by providing only the current addition circuit, to perform a fine regulation by setting the current generated by the reference current generator circuit on a lower limit side of the variation. On the contrary, the regulation is possible by only the current subtraction circuit by setting it on an upper limit side of the variation.

Further, since, at present, the difference in luminance between organic EL element materials for the respective G and B display colors is not large compared with that for the R display color, a single reference current setting circuit may be commonly used for the G and B display colors.

Incidentally, although the described embodiments are constructed with the MOS FETs mainly, it may be constructed with bipolar transistors mainly. Further, the N channel (or NPN) type transistors may be replaced by P channel (or PNP) type transistors and the P channel type transistors may be replaced by N channel (or NPN) type transistors.

What is claimed is:

1. An organic EL element drive circuit including a reference current setting circuit for generating a predetermined reference current for at least one of three primary display colors by receiveing a first reference current supplied from a first reference current generator circuit, said reference current setting circuit comprising:

a second reference current generator circuit responsive to a first setting data for generating a current as a reference for luminance regulation on a basis of the first reference current; and a reference current correction circuit for generating a corrected reference current as said predetermined reference current by adding a current according to a second setting data to a reference current generated by said second reference current generator circuit or subtracting a current according to said second setting data from said reference current generated by said second reference current generator circuit, said first and second setting data being set from the outside of said organic EL element drive circuit.

2. An organic EL element drive circuit as claimed in claim 1, wherein said second reference current generator circuit and said reference current correction circuit are provided for every primary display color.

3. An organic EL element drive circuit as claimed in claim 2, further comprising a memory for storing the first and second setting data, wherein each of said second reference current generator circuit and said reference current correction circuit includes a plurality of switch circuits and the corrected reference current is generated by ON/OFF controlling the plurality of said switch circuits according to the first and second setting data read out from said memory.

4. An organic EL element drive circuit as claimed in claim 3, wherein said memory is a non-volatile memory and said second reference current generator circuit includes a first current mirror circuit having an input side transistor and a plurality of output side transistors, output sides of the plurality of said output side transistors being connected to a first output terminal for outputting the current generated by said second reference current generator circuit through the plurality of said switch circuits, respectively.

5. An organic EL element drive circuit as claimed in claim 4, wherein said reference current correction circuit includes an input terminal for receiving the current from said first output terminal, a second output terminal, a correction current generator circuit and a current synthesizer circuit for outputting the corrected reference current to said second output terminal and said corrected current generator circuit includes a second and third current mirror circuits each having an input side transistor and a plurality of output side transistors, output sides of the plurality of said output side transistors of said second and third current mirror circuits being connected to said input terminal or said second output terminal through a plurality of switch circuits provided for each of said second and third current mirror circuits.

6. An organic EL element drive circuit as claimed in claim 5, wherein said current synthesizer circuit includes a fourth current mirror circuit having an input side transistor connected to said input terminal and a output side transistor connected to said second output terminal and generates a current to be sunk from the current at said second output terminal.

7. An organic EL element drive circuit as claimed in claim 6, wherein said input side transistors of said second and third current mirror circuits are driven by constant current sources, respectively, and said second current mirror circuit is a current addition circuit for adding a current to sunk to the current at said second output terminal and said third mirror circuit is a current subtraction circuit for subtracting a current to be sunk from the current at said second output terminal.

8. An organic EL element drive circuit as claimed in claim 7, wherein the plurality of said output side transistors of said second current mirror circuit are connected to said second output terminal through the plurality of said switch circuits and the plurality of said output side transistors of said third current mirror circuit are connected to said input terminal through the plurality of said switch circuits.

9. An organic EL element drive circuit as claimed in claim 6, wherein said second mirror circuit is a current addition circuit for adding a current to sunk to the current at said second output terminal and said third mirror circuit is a current subtraction circuit for subtracting a current to be sunk from the current at said second output terminal.

10. An organic EL element drive circuit as claimed in claim 9, wherein said input side transistor of said fourth current mirror circuit is said input side transistor of said second current mirror circuit and said output sides of the plurality of said output side transistors of said second current mirror circuit are connected to said second output terminal through the plurality of said switch circuits.

11. An organic EL element drive circuit as claimed in claim 10, wherein said input side transistor of said third current mirror circuit is driven through said input side transistor of said fourth current mirror circuit and output sides of the plurality of said output side transistors of said third current mirror circuit are connected to said second output terminal through the plurality of said switch circuits.

12. An organic EL display device comprising a plurality of drive circuits of an active matrix type organic EL display panel as claimed in any of claims 1 to 8.

* * * * *